US007467935B2

(12) United States Patent
Betz et al.

(10) Patent No.: US 7,467,935 B2
(45) Date of Patent: Dec. 23, 2008

(54) LOW INPUT TORQUE ROTOR FOR VANE PUMP

(75) Inventors: Michael A Betz, Huxley, IA (US); Eric D Bretey, Rowan, IA (US); Robert J Klinkel, Ames, IA (US); Kevin J Landhuis, Ankeny, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 528 days.

(21) Appl. No.: 10/944,031

(22) Filed: Sep. 17, 2004

(65) Prior Publication Data

US 2006/0073031 A1 Apr. 6, 2006

(51) Int. Cl.
*F03C 4/00* (2006.01)
*F04C 18/00* (2006.01)

(52) U.S. Cl. ..... 418/259; 418/151; 418/152; 418/178

(58) Field of Classification Search ..... 418/123, 418/151, 152, 235, 225, 259, 178, 179
See application file for complete search history.

(56) References Cited

U.S. PATENT DOCUMENTS

| | | | | | |
|---|---|---|---|---|---|
| 2,004,563 | A | * | 6/1935 | Bogoslowsky | 418/151 |
| 2,781,000 | A | * | 2/1957 | Thomas et al. | 418/151 |
| 3,102,520 | A | * | 9/1963 | Schlor | 418/179 |
| 4,198,195 | A | * | 4/1980 | Sakamaki et al. | 418/152 |
| 4,820,140 | A | * | 4/1989 | Bishop | 418/179 |
| 5,560,741 | A | | 10/1996 | Edwards | |
| 6,503,064 | B1 | | 1/2003 | Croke et al. | |
| 7,037,093 | B2 | * | 5/2006 | Jong | 418/255 |

FOREIGN PATENT DOCUMENTS

| | | | | | |
|---|---|---|---|---|---|
| EP | 1239115 | A2 | * | 9/2002 | |
| JP | 53058807 | A | * | 5/1978 | 418/178 |
| JP | 05-058888 | U | * | 5/1993 | |
| JP | 2003222089 | A | * | 8/2003 | |
| WO | WO02062459 | A1 | * | 8/2002 | 418/152 |

* cited by examiner

*Primary Examiner*—Theresa Trieu

(57) ABSTRACT

A vane-type fluid displacement unit having a housing, a drive shaft extending through the housing, a rotor secured to the drive shaft and disposed within the housing, the rotor having at least one non-smooth top or bottom surface, and at least one vane secured to the rotor.

3 Claims, 4 Drawing Sheets

LOW INPUT TORQUE ROTOR FOR VANE PUMP

BACKGROUND OF THE INVENTION

The present invention relates generally to fluid handling machines and, more particularly, to vane-type fluid displacement units having features of improved design.

Vane-type fluid displacement units are well known in the art. One such example of a typical vane pump is disclosed in U.S. Pat. No. 6,503,064 to Croke et al., which discloses a rotor having smooth top and bottom surfaces. Typically, the top and bottom surfaces of rotors are ground smooth to a surface finish of Ra 4-20 micro inches. Because of the ground surfaces of the rotor, fluid passing through the vane pump exerts a shear force on the rotor, thereby requiring greater input torque.

U.S. Pat. No. 5,560,741 to Edwards discloses a vane pump having a rotor with a trepanned or recessed portion centrally located on the top and bottom surfaces. The purpose of this recessed portion is to provide undervane fluid an escape path as the vanes move radially inward during rotation of the rotor and has no bearing upon the shear force exerted by the fluid on the rotor. Accordingly, there is a need in the art for an improved rotor that reduces the shear force exerted by the fluid on the top and bottom surfaces of the rotor.

It is therefore a principal object of the present invention to provide an improved vane-type displacement unit that operates with a minimum amount of input torque.

A further object of the present invention is to provide an improved rotor for a vane-type displacement unit that reduces the amount of shear force exerted by the fluid passing therethrough.

These and other objects will be apparent to those skilled in the art.

BRIEF SUMMARY OF THE INVENTION

The present invention is directed toward a vane-type fluid displacement unit having a housing, a drive shaft extending through the housing, a rotor secured to the drive shaft and disposed within the housing, and at least one vane secured to the rotor.

The rotor has at least one non-smooth top or bottom surface. Specifically, in one embodiment, the top and bottom surfaces of the rotor are dimpled. Alternatively, the top and bottom surfaces of the rotor have slots, holes, pockets, or a shot peen pattern. As such, the non-smooth top and bottom surfaces introduce fluid turbulences across the rotor that reduce the shear force of the fluid against the rotor, thereby reducing the required input torque.

DESCRIPTION OF THE PREFERRED EMBODIMENTS OF THE INVENTION

As used herein, those skilled in the art will appreciate that a vane-type fluid displacement unit encompasses both vane-type pumps and motors.

Figure 1:
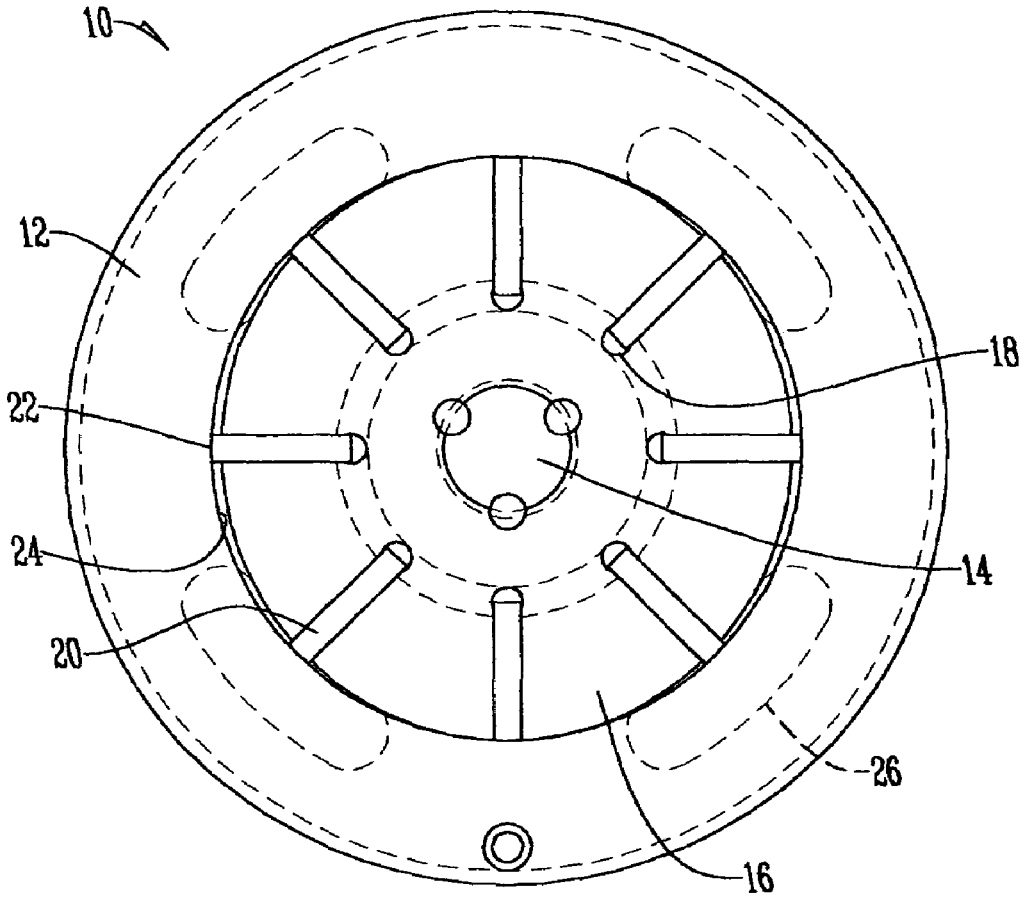
FIG. 1 is a plan view of a vane-type fluid displacement unit of the present invention.

With reference to FIG. 1, a typical vane-type fluid displacement unit 10 is shown having a cam ring or housing 12, a drive shaft 14 extending through the housing 12, a rotor 16 secured to the drive shaft 14 and having slots 18 for receiving vanes 20. Fluid pressure within the slots 18 forces the vanes 20 radially outward such that the tips 22 of the vanes engage with the inner diameter 24 of the housing 12. In this manner, the vanes 20 sweep fluid compressed between the rotor 16 and inner diameter 24 of the housing 12 between inlet/outlet ports 26, as is well known in the art.

With reference to FIGS. 2-6, the rotor 16 is generally circular in shape with an outer side surface 28 and a top surface 30 opposite a bottom surface 32. Rotor 16 further includes a central aperture 34 to matingly receive the drive shaft 14. As shown in FIGS. 2-6, slots 18 are adapted to receive roller-type vanes. Those skilled in the art will appreciate that slots 18 can be adapted such that rotor 16 can be used with conventional vanes, as shown in FIG. 1.

Figure 2:
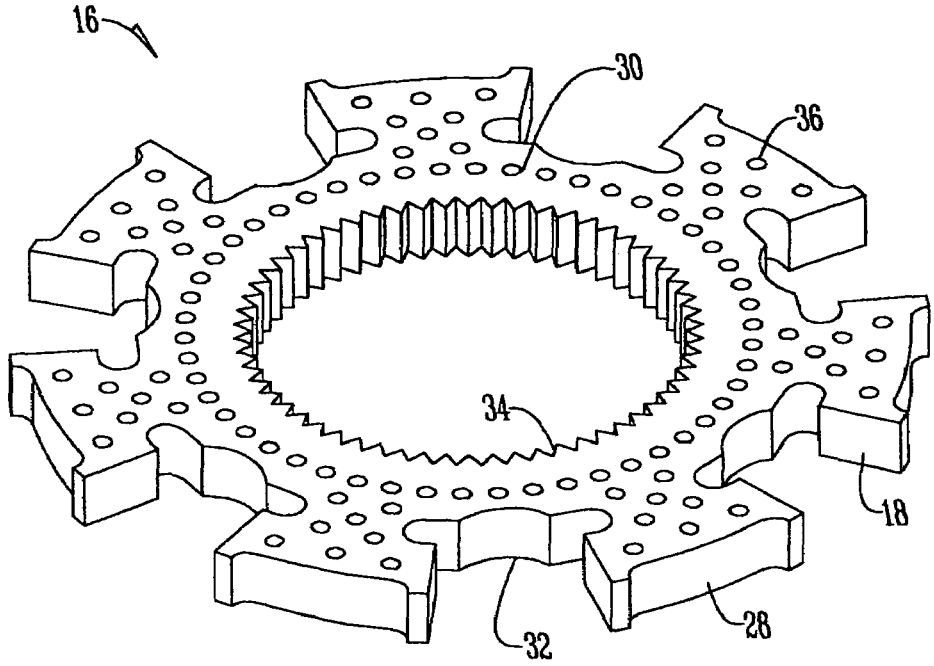
FIG. 2 is a plan view of a rotor of an embodiment of the present invention.
Figure 3:
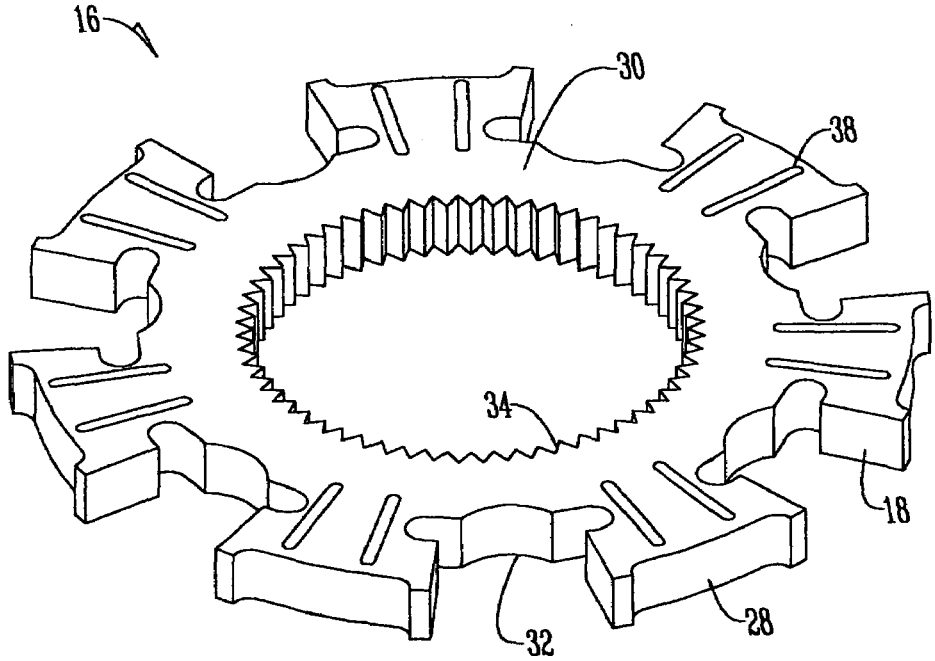
FIG. 3 is a plan view of a rotor of another embodiment of the present invention.
Figure 4:
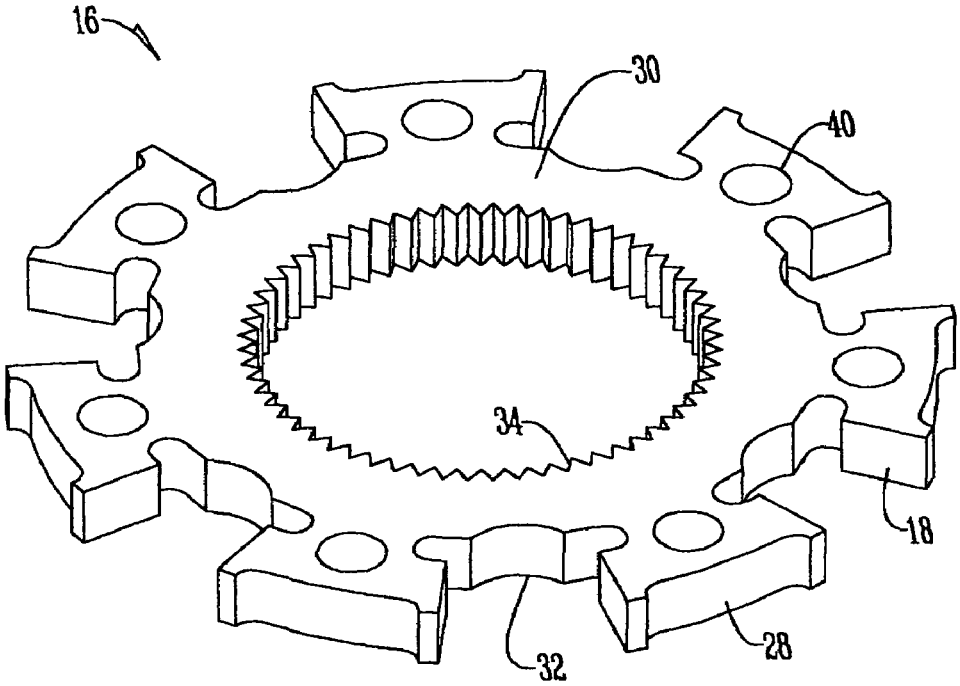
FIG. 4 is a plan view of a rotor of another embodiment of the present invention.
Figure 5:
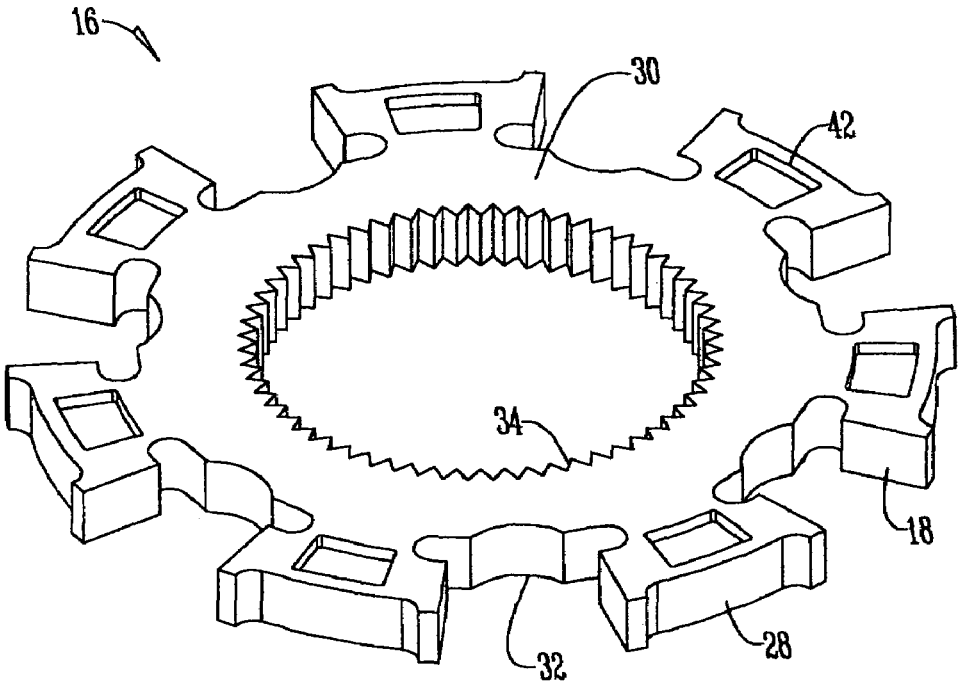
FIG. 5 is a plan view of a rotor of another embodiment of the present invention.
Figure 6:
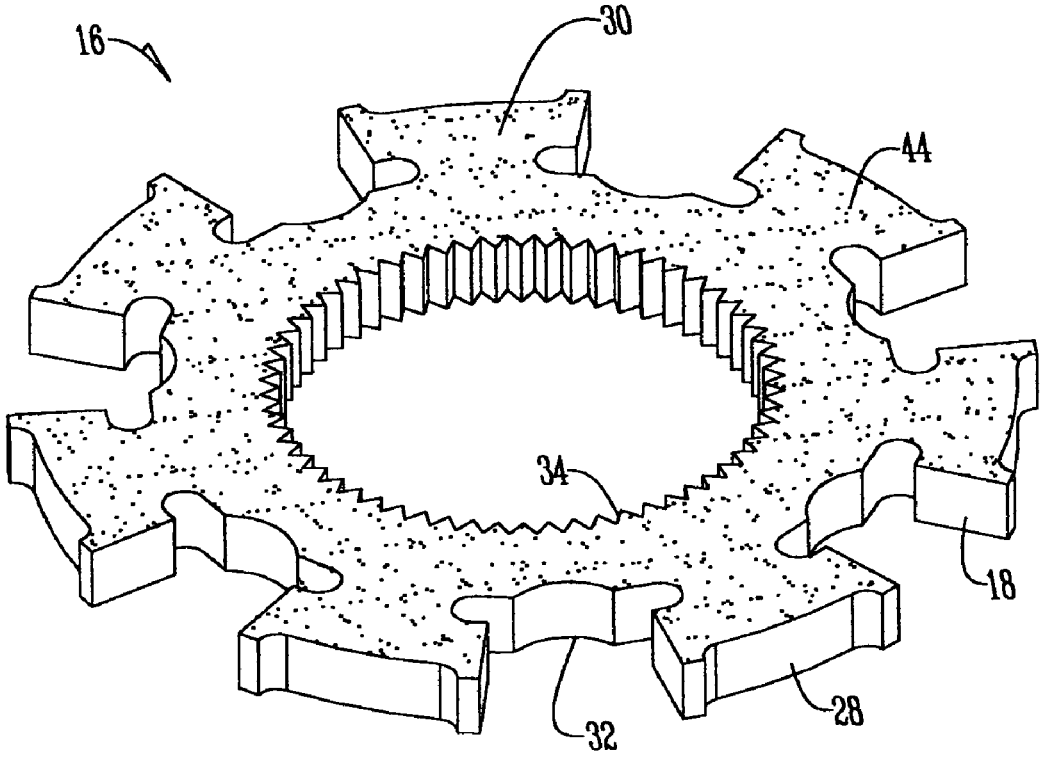
FIG. 6 is a plan view of a rotor of another embodiment of the present invention.

At least one of the top or bottom surfaces 30 and 32 of the rotor 16 is non-smooth in order to introduce fluid turbulence across the rotor 16, thereby reducing the fluid shear force acting thereon. Preferably, both the top and bottom surfaces 30 and 32 are non-smooth. Specifically, as shown in FIG. 2, the top and bottom surfaces 30 and 32 have a plurality of dimples 36 evenly spaced across the top and bottom surfaces of rotor 16. Alternatively, as shown in FIG. 3, the top and bottom surfaces 30 and 32 have a plurality of slots 38 adjacent slots 18 and extending radially outward from the central aperture 34. Alternatively still, as shown in FIG. 4, the top and bottom surfaces 30 and 32 have a plurality of holes 40 adjacent slots 18 and bored completely through rotor 16. In another alternative embodiment, as shown in FIG. 5, the top and bottom surfaces 30 and 32 of rotor 16 have pockets 42 adjacent slots 18. Unlike the holes 40 shown in FIG. 4, pockets 42 only extend partially through the rotor 16. Alternatively still, as shown in FIG. 6, the top and bottom surfaces 30 and 32 have a shot peen pattern 44 substantially covering the entire top and bottom surfaces of rotor 16. The shot peen pattern 44 preferably has a roughness of at least Ra 50 micro inches.

In operation, the vane-type displacement unit 10 operates with a minimum amount of input torque exerted on drive shaft 14 as a result of the improved rotor 16. Specifically, the non-smooth top and bottom surfaces 30 and 32 of the rotor 16, as shown in FIGS. 2-6, serve to introduce turbulences in the fluid adjacent the top and bottom surfaces acting on the rotor. The fluid turbulences reduce the shear force exerted by the fluid on the top and bottom surfaces 30 and 32, thereby reducing the amount of torque required to drive the rotor 16.

The effect of the non-smooth top and bottom surfaces 30 and 32 on the input torque is substantial. The use of the dimples 36 shown in FIG. 2 reduce the input torque by approximately 2.49% as compared to a conventional smooth surface rotor operating at 4000 RPM at constant temperature. Similarly, the use of the slots 38 shown in FIG. 3 reduce input torque by approximately 5.67%, the holes 40 shown in FIG. 4 by approximately 6.95%, the pockets 42 shown in FIG. 5 by approximately 11.87%, and the shot peen pattern 44 shown in FIG. 6 reduces the input torque by approximately 13.53%.

Greater torque reduction is achieved through combining the interference patterns of FIGS. 2-6. For instance, a rotor 16 having top and bottom surfaces 30 and 32 with both the holes 40 shown in FIG. 4 and the shot peen pattern of FIG. 6 reduces input torque by approximately 18.33%. Similarly, the combination of the pockets 42 shown in FIG. 5 and the shot peen pattern 44 reduces input torque by approximately 24.34% over a conventional smooth surfaced rotor.

It is therefore seen that through the use of an improved rotor with non-smooth top and bottom surfaces, the present invention reduces the amount of shear force exerted by the fluid, thereby permitting operation of a vane-type displacement unit with a minimum amount of input torque.

What is claimed is:

1. A vane-type fluid displacement unit comprising:

a housing;

a drive shaft extending through the housing;

a rotor secured to the drive shaft and disposed within the housing, the rotor having at least one non-smooth top or bottom surface; and a plurality of vanes secured within a plurality of slots of the rotor; and wherein the top and bottom surfaces of the rotor have a plurality of dimples evenly spaced across the entire top and bottom surfaces of the rotor.

2. A vane-type fluid displacement unit comprising:

a housing;

a drive shaft extending through the housing;

a rotor secured to the drive shaft and disposed within the housing, the rotor having at least one non-smooth top or bottom surface; and a plurality of vanes secured within a plurality of slots of the rotor wherein the top and bottom surfaces of the rotor have a plurality of elongated slots extending radially outward and disposed therethrough wherein two of the plurality of elongate slots are between each slot of the rotor.

3. A vane-type fluid displacement unit comprising:

a housing;

a drive shaft extending through the housing;

a rotor secured to the drive shaft and disposed within the housing, the rotor having at least one non-smooth top or bottom surface; and a plurality of vanes secured within a plurality of slots of the rotor wherein the top and bottom surfaces of the rotor have a plurality of pockets extending partially therethrough.

* * * * *